United States Patent [19]

Quinlan, Jr.

[11] Patent Number: 4,768,825

[45] Date of Patent: Sep. 6, 1988

[54] HIGH CHAIR WITH COLLAPSIBLE FRAME

[75] Inventor: Robert L. Quinlan, Jr., Stow, Ohio

[73] Assignee: Gerber Products Company, Fremont, Mich.

[21] Appl. No.: 29,282

[22] Filed: Mar. 23, 1987

[51] Int. Cl.[4] ..... A47C 4/00

[52] U.S. Cl. ..... 297/39; 297/35

[58] Field of Search ..... 297/35, 36, 37, 38, 297/39, 40, 41, 354, 406, 407, 29

[56] References Cited

U.S. PATENT DOCUMENTS

| | | | |
|---|---|---|---|
| 2,483,633 | 10/1949 | Froelich | 297/149 |
| 2,710,645 | 6/1955 | Luckhardt | 297/29 X |
| 3,695,685 | 10/1972 | Lamb | 297/29 |
| 4,451,082 | 5/1984 | Giordani | 297/464 |
| 4,580,833 | 4/1986 | Waples | 297/39 |
| 4,588,228 | 5/1986 | Nemoto | 297/354 |
| 4,613,185 | 9/1986 | Marchesihi | 297/39 |

FOREIGN PATENT DOCUMENTS

| | | | |
|---|---|---|---|
| 132080 | 4/1949 | Australia | 297/39 |
| 524460 | 10/1953 | Canada | 297/39 |
| 610489 | 10/1960 | Italy | 297/39 |
| 815024 | 6/1959 | United Kingdom | 297/39 |

*Primary Examiner*—James T. McCall

*Attorney, Agent, or Firm*—Townsend and Townsend

[57] ABSTRACT

A foldable high chair requiring only four pivot joints and a combination pivot and sliding joint on each side is disclosed. Three of the four pivot joints are spaced along each side arm, the first connecting the side arm to the back of the high chair, and the second and third joining the side arm with the rear and front legs of the high chair, respectively. The fourth pivot joint on each side joins the front leg with the seat of the high chair, and the combination joint joins the seat to the chair back in a pivoting relationship, and the rear leg to both in a sliding relationship. By virtue of this arrangement, only four rivets are needed per side. Also disclosed is a lock-and-release mechansim associated with the combination joints and operated by a single trigger underneath the chair seat.

6 Claims, 4 Drawing Sheets

HIGH CHAIR WITH COLLAPSIBLE FRAME

BACKGROUND OF THE INVENTION

This invention relates to infants high chairs. These chairs generally consist of a back, seat, and pair of arm rests across which a table is mounted. The high chair is foldable for purposes of transport and storage, and due to the various different parts involved—back, seat, arms, and front and rear legs on each side—these chairs are usually designed with a large number of pivot connections, together with associated locks and levers. Such devices are expensive to construct and complex in operation.

SUMMARY OF THE INVENTION

A novel foldable high chair is now provided which includes a collapsible frame relying only on four pivot joints and a combination pivot and sliding connection. These five connections together coordinate the seat back, seat and arm rest on each side for the full range of motion between the open and folded positions. They further accommodate a lock-and-release mechanism for holding the high chair in either of the folded and open positions, thus combining simple and sturdy construction with ease of operation. Preferred embodiments of the invention reflect the placement of the joints with respect to each other, and particularly their relative spacings. Still further preferred embodiments address a lock-and-release mechanism beneath the high chair which unlocks by compressing a single spring, and locks both sides simultaneously by releasing the spring.

Further preferred embodiments will be apparent from the description which follows.

DETAILED DESCRIPTION OF THE INVENTION AND PREFERRED EMBODIMENTS

Figure 1:
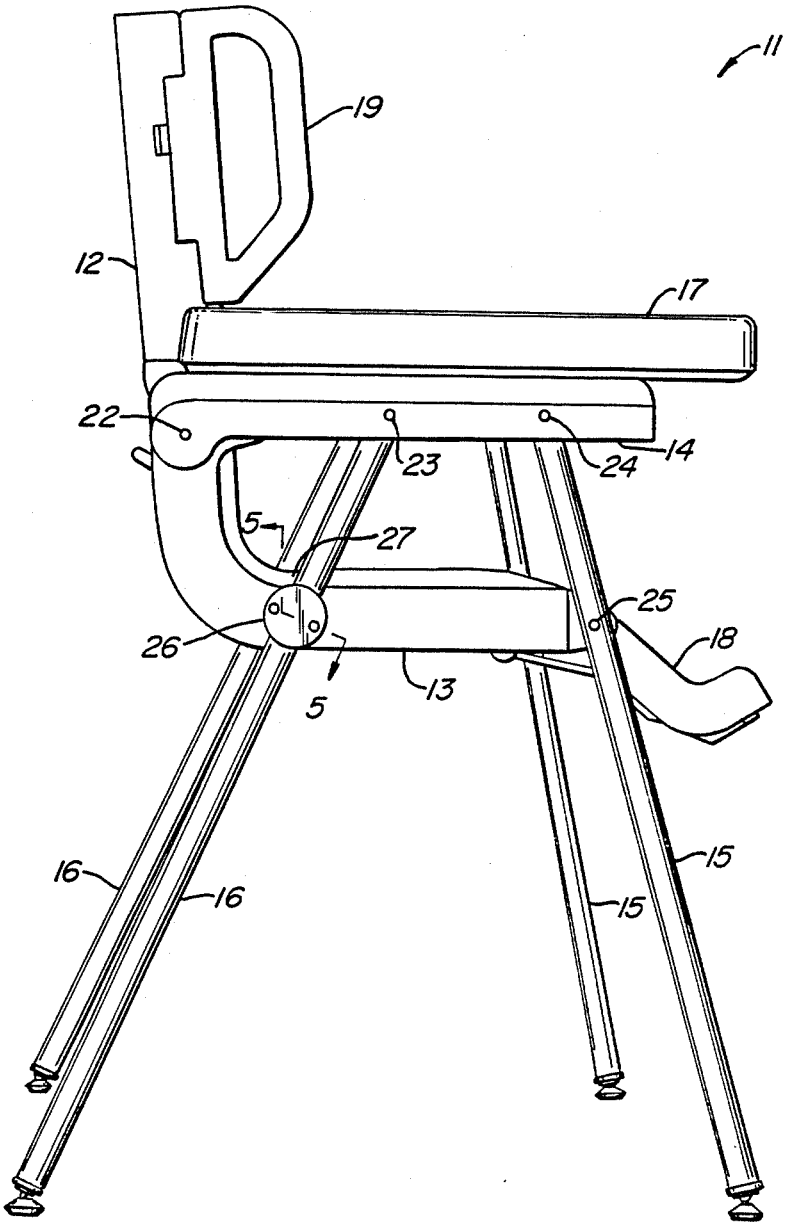
FIG. 1 is a side elevation of an assembled high chair in accordance with the present invention.

Shown in FIG. 1 is a foldable high chair 11 in accordance with the present invention. Component parts of the high chair for purposes of the present invention include a back panel 12, a seat 13, a pair of arms 14 (of which only the right arm is shown), front legs 15 and rear legs 16. Also shown in the figure are a tray 17 resting across the arms 14, a foot rest 18 extending forward and downward from the front edge of the seat 13, and a wing-chair type lateral head support 19 attached by a hinge connection to the side of the back panel 12. Two such lateral head supports will be included, one on each side. Only the one on the right side is shown.

The high chair is shown in the open or unfolded position. Folding is achieved by first removing the tray 17, either opening or closing the lateral head supports 19 so that they are parallel with the back panel 12, and rotating the arm rests 14 and the seat 13 upward so that the arm rests are parallel and adjacent to the back panel 12 and the seat is parallel and in front of the back panel 12.

The folding operation involves pivoting the various parts at first, second and third pivot joints 22, 23, 24 spaced longitudinally along the arm rest 14 and a fourth pivot point 25 and a combination pivot and sliding joint 26 spaced longitudinally along the seat 13. The first pivot joint 22 is a connection between the seat back 12 and the arm rest 14. The second and third pivot joints 23 and 24 join the arm rest 14 to the rear leg 16 and front leg 15, respectively. The fourth pivot joint 25 connects the front leg 15 to one of the front corners of the seat 13, and the combination pivot and sliding joint 26 connects the rear leg 16, seat 13 and back panel 12. The combination joint 26 consists of a pivot connection between the seat 13 and the back panel 12, and a sliding connection for the rear leg 16, permitting the rear leg to slide with respect to the point at which the seat 13 and back panel 12 are joined. As the high chair is folded, the back leg 16 slides upward through the combination joint 26.

In the embodiment shown, the spacing between the second and third pivot joints 23, 24 is narrower than the spacing between the fourth pivot joint 25 and the combination joint 26. This provides the structure with an A-frame type construction, adding stability to the high chair by spreading apart the lower ends of the legs. It will also be noted that the bottom edge 27 of the back panel is curved forward. The combination joint 26 is therefore forward of the first pivot joint 22. The seat 13 may thus be folded flat against the back panel 12.

Figure 2A:
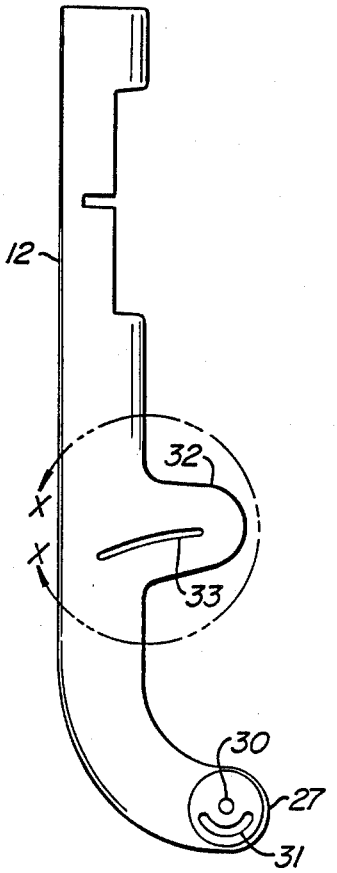
FIG. 2*a* is a side elevation of the back panel of the high chair shown in FIG. 1.

The back panel itself is shown in FIG. 2*a*. The portion at the bottom edge 27 which forms part of the combination pivot and sliding joint 26 of FIG. 1 consists of a central pivot hole 30 which defines the fulcrum around which the seat 13 of FIG. 1 pivots, and a curved slot 31. The latter is included to provide a passageway for a bolt which forms part of the lock-and-release mechanism. Both the bolt and the mechanism itself are shown in subsequent drawings and described in detail below.

bracket 32 with an elongated slot 33 which forms part of the first pivot joint 22 shown in FIG. 1 joining the back panel with the arm 14. One such bracket and elongated slot are placed on each side of the back panel 12. Only those on the right hand side are shown in the drawing.

In preferred embodiments, the first pivot joint 22 is adjustable to permit the back panel 12 to be placed at any of several angles with respect to the seat. This is the function of the elongated slot 33, which is curved to follow the arc described by the rotation of the back panel 12. In simpler embodiments which do not include this feature, the elongated slot 33 would be replaced by a simple hole forming the fulcrum of the pivot joint.

Figure 2B:
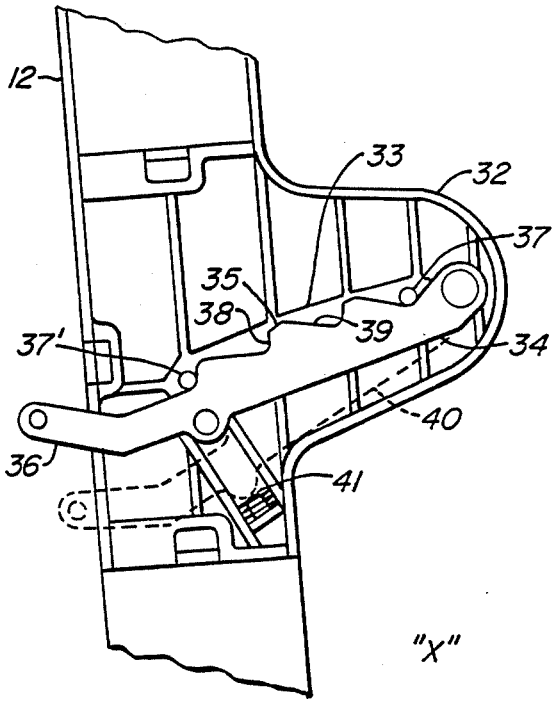
FIG. 2*b* is a detail view of the portion designated X in FIG. 2*a*.

The structural details which provide for adjustment of the fulcrum at various points along the slot 33 are shown in FIG. 2*b*. A lever 34 with ratchet teeth 35 and an arm 36 protruding back from the rear of the back panel controls the recline position. Also shown in this view, although not part of the bracket, is a rivet 37 which passes through the bracket and the pivoting arm rest to serve as the fulcrum for rotation. Two positions of the rivet 37 and 37' are shown, representing the two extremes of the adjustment.

The ratchet teeth 35 are oriented to catch the rivet on their left side 38, the right sides 39 being sloped to permit the rivet 37 to depress the lever 34 as the seat back panel 12 (and hence the lever 34) are rotated forward (to the right). The lever will thus permit forward rotation of the seat back but not backward rotation without depressing the lever 34. The depressed position of the lever is shown in dashed lines 40. A coil spring 41 is placed beneath the lever 34 to bias the lever upward and thereby engage the ratchet teeth 35 with the rivet 37.

Figure 3:
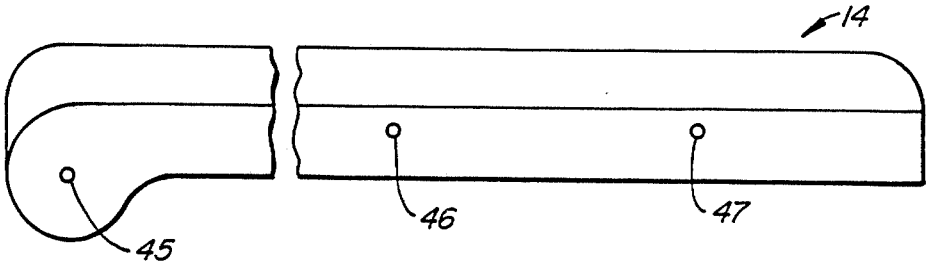
FIG. 3 is a side elevation of the right arm rest of the high chair shown in FIG. 1.
Figure 4:
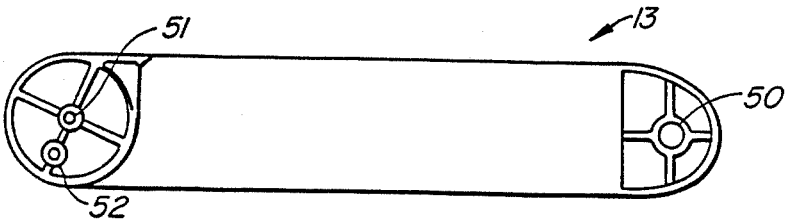
FIG. 4 is a side elevation of the seat of the high chair shown in FIG. 1.

The right side arm 14 and the right side edge of the seat 13 are shown in FIGS. 3 and 4, respectively. In the side arm 14, rivet holes 45, 46 and 47 are shown for the first, second and third pivot joints, respectively. In the seat 13, rivet holes 50 and 51 are shown for the fourth pivot joint and the combination pivot and sliding joint, respectively. A further hole 52 provides a through passage for the bolt (mentioned above) in the lock-and-release mechanism.

Figure 5:
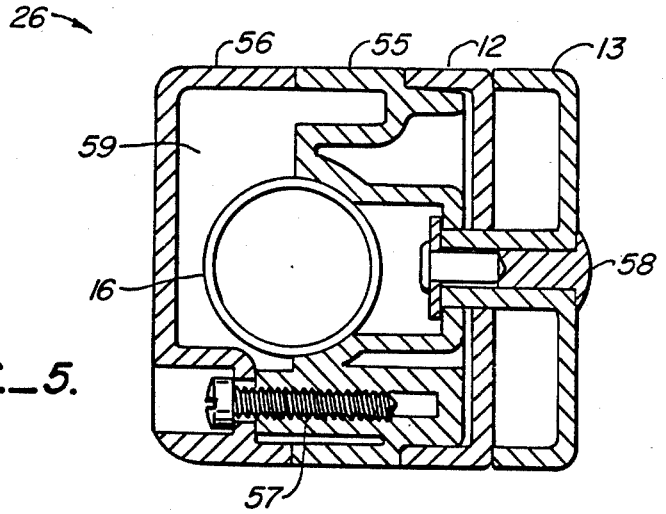
FIG. 5 is a cutaway view of the combination pivot/sliding joint of the high chair of FIG. 1, taken along line 5—5 thereof.

A cross-section view of the combination pivot and sliding joint 26 is shown in FIG. 5. The component parts of this joint, from the inside out, are a portion of the seat 13, a portion of the seat back 12, a rotating insert 55 and a cap 56. The cap is secured to (and fixed with respect to) the rotating insert 55 by a pair of screws, only one of which 57 is shown in this view, so that both will rotate as a unit. This unit, the seat back 12 and the seat 13 all rotate with respect to each other about a rivet 58 when the seat is rotated either up or down. The rear leg 16 is shown in this embodiment as a tube of circular cross section which passes through a space between the rotating insert 55 and the cap 56. As the parts rotate with respect to each other, the tubular leg 16 slides through the space 59 in the direction perpendicular to the plane of the drawing.

Figure 6:
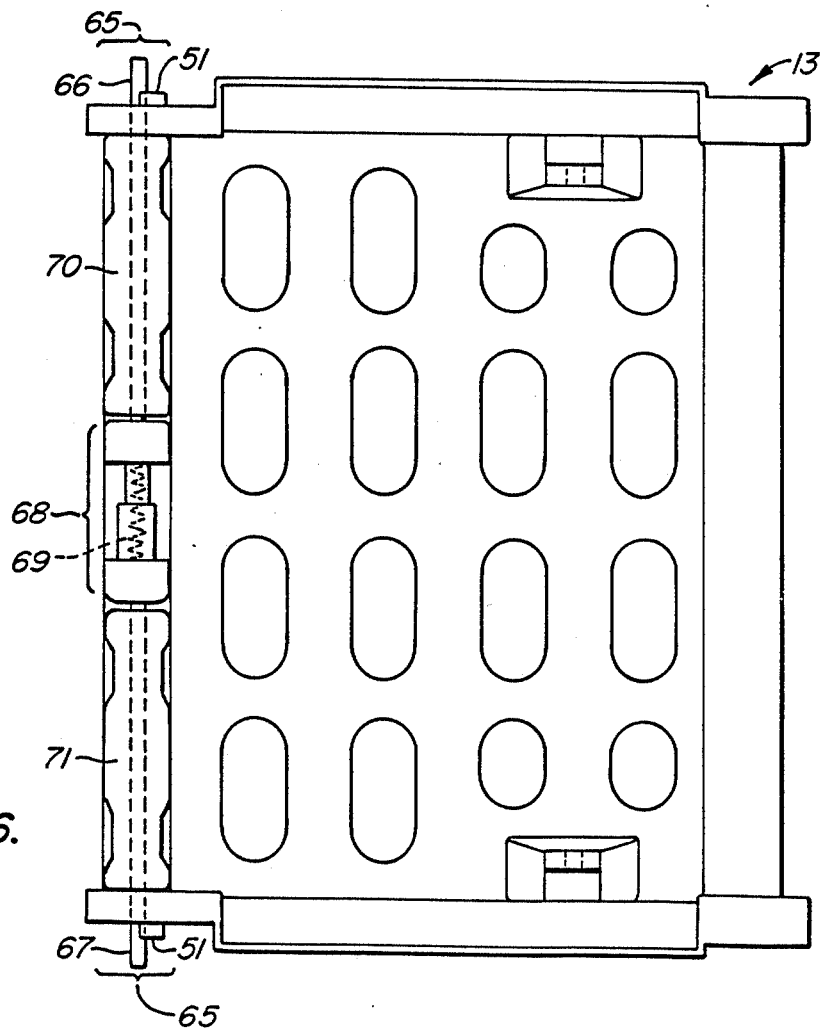
FIG. 6 is a plan view of the seat of the high chair of FIG. 1, shown from underneath.

The underside of the seat 13 is shown in FIG. 6. The two rivet holes 51 for the combination pivot and sliding joints at either side of the high chair are shown at the left of the drawing. The lock-and-release mechanism 65 is also shown. The latter consists of the aforementioned bolts 66, 67, a central trigger 68, a compression spring 69 inside the trigger, and shields 70, 71 for the bolts. The bolts in this embodiment are elongated rods extending from opposite sides of the trigger 68 toward and past the side edges of the seat. Each bolt protrudes far enough to enter holes in the tubular rear legs, thereby locking the legs in nonsliding positions. The shields 70, 71 hold the bolts against the underside of the seat.

Figure 7:
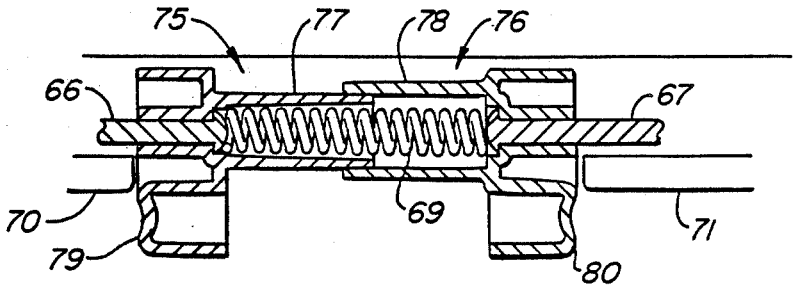
FIG. 7 is a cutaway view of the lock-and-release mechanism shown in FIG. 6.

A close-up cutaway view of the trigger 68 and its internal spring 69 appears in FIG. 7. The trigger consists of two parts 75, 76 which together form a chamber enclosing the internal spring 69. Each of the two parts contains a sleeve 77, 78 sized to receive one end of the spring 69. The sleeves are of different diameters with one sleeve 77 fitting loosely inside the other 78 to permit sliding of the larger over the smaller as the spring 69 is compressed. Finger grips 79, 80 extend downward from each of the two halves of the trigger. These finger grips are spaced close enough together so that they may be grasped simultaneously by one hand (thumb and forefinger). When the finger grips are squeezed together, the bolts 66, 67 are retracted simultaneously.

Figure 8A:
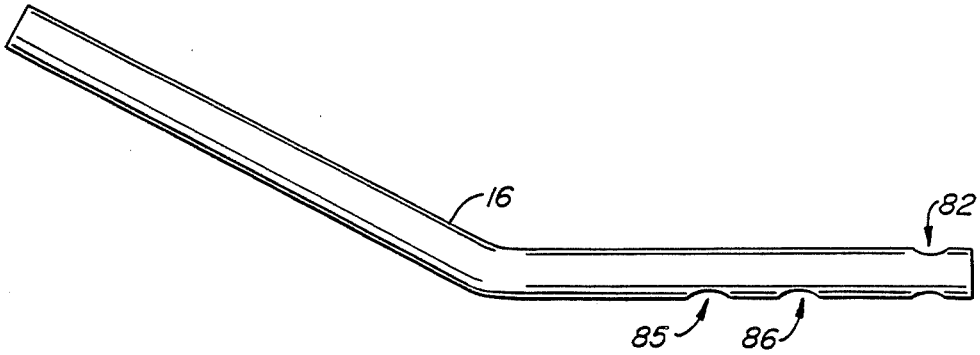
FIGS. 8*a* and 8*b* are views of the rear and front legs, respectively, of the high chair shown in FIG. 1, as viewed from the front of the high chair.
Figure 8B:
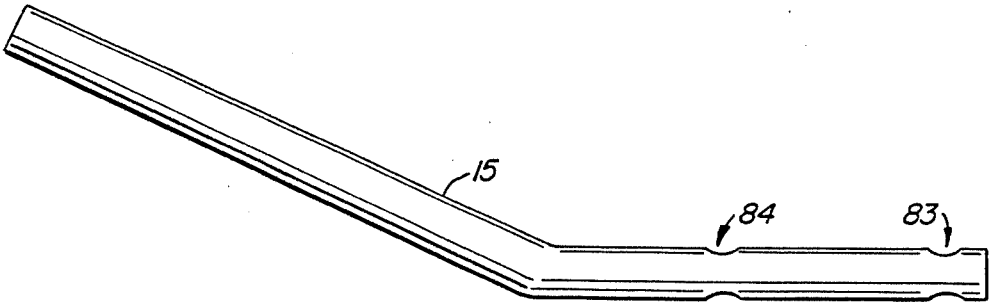

Rear and front legs are shown in FIGS. 8*a* and 8*b*, respectively. The legs in these drawings are bent at a location midway between their ends, such that when mounted to the high chair, they will extend to the side at an angle, in addition to being angled front and back. A through passage 82 is shown in the rear leg for a rivet (not shown) at the fulcrum of the second pivot joint 23 (FIG. 1). Similarly, a through passage 83 is shown in the front leg for a rivet forming the fulcrum of the third pivot joint 24. A further through passage 84 in the front leg receives a rivet for the fourth pivot joint 25 at the point where this leg meets the seat 13. A pair of holes 85, 86 which are not through passages are placed in the rear leg 16 on the side facing inward. These holes, which are preferably dimpled, are sized to receive one of the bolts 66, 67 (FIG. 6). The two holes 85, 86 represent the two positions of the high chair, i.e., folded (for storage or transportation) and open (for use), respectively.

The foregoing is offered primarily for purposes of illustration. It will be readily apparent to those skilled in the art that numerous modifications and variations of the various details of construction and operation as described above may be introduced without departing from the spirit and scope of the invention.

What is claimed is:

1. In a foldable high chair comprising a back panel, a seat, a pair of arms to support a tray, and rear and front legs on each side, in which said seat and said arms are pivotally joined to said back panel to permit folding said seat and said arms against said back panel, the improvement comprising:

first, second and third pivot joints spaced along each said arm joining each said arm to said back panel, a rear leg and a front leg respectively;

a fourth pivot joint on each side joining said seat to one front leg;

a fifth joint on each side pivotally joining said seat to said back panel and slidably joining one rear leg to said seat and said back panel; and means for releasably locking at least one said rear leg at two nonsliding positions with respect to said fifth joint, the first said nonsliding position holding said high chair fully open and the second said nonsliding position holding said high chair fully folded.

2. A foldable high chair in accordance with claim 1 in which the distance between said second and third pivot points is less than the distance between said fourth pivot point and said fifth joint.

3. A foldable high chair in accordance with claim 1 in which the bottom edge of said back panel is curved forward, and said fifth joint is spaced forward of said first pivot joint.

4. A foldable high chair in accordance with claim 1 in which said releasable locking means is comprised of a spring-mounted retractable bolt, and first and second holes in the side of said rear leg, corresponding to said first and second nonsliding positions respectively, to receive said spring-mounted retractable bolt.

5. A foldable high chair in accordance with claim 1 comprising first and second rear legs mounted on opposite sides of said foldable high chair; first and second spring-mounted retractable bolts extending toward said first and second rear legs, respectively, from opposite ends of a common spring beneath said seat; first and second holes in each of said first and second rear legs, corresponding to said first and second nonsliding positions, respectively, to receive said spring-mounted retractable bolts; and means for compressing said spring, thereby retracting both said first and second spring-mounted retractable bolts simultaneously from said holes.

6. A foldable high chair in accordance with claim 1 in which said first pivot joint is adjustable to vary the angle of said back panel with respect to said seat when said high chair is open.

* * * * *